United States Patent [19]

Grosseau

[11] 4,039,637

[45] Aug. 2, 1977

[54] FUEL SUPPLY SYSTEMS FOR HEAT GENERATORS

[75] Inventor: Albert Grosseau, Chaville, France

[73] Assignee: Societe Anonyme Automobiles Citroen, France

[21] Appl. No.: 666,428

[22] Filed: Mar. 12, 1976

[30] Foreign Application Priority Data

Mar. 20, 1975 France ..... 75.08772

[51] Int. Cl.[2] ..... F02M 69/02

[52] U.S. Cl. ..... 261/36 A; 123/136; 123/139 AW; 123/139 BG; 137/101.25; 137/117; 431/90

[58] Field of Search ..... 261/36 A; 431/90; 123/136, 139 AW, 139 BG; 137/117, 101.25

[56] References Cited

U.S. PATENT DOCUMENTS

| | | | |
|---|---|---|---|
| 1,909,390 | 5/1933 | Ball et al. | 261/36 A |
| 2,269,705 | 1/1942 | Besler | 431/90 |
| 2,341,257 | 2/1944 | Wunsch | 123/140 |
| 2,916,270 | 12/1959 | Dermond | 123/139 AW |
| 2,954,018 | 9/1960 | Dermond | 123/139 AW |
| 2,979,124 | 4/1961 | Kirk | 431/90 |
| 2,998,232 | 8/1961 | Mennesson | 261/36 A |
| 3,127,453 | 3/1964 | Sarto | 261/36 A |
| 3,276,508 | 10/1966 | Stierlin | 123/136 |
| 3,288,445 | 11/1966 | Mennesson | 261/36 A |
| 3,302,935 | 2/1967 | York, Jr. | 261/36 A;29 |
| 3,817,231 | 6/1974 | O'Neil | 123/139 AW |

FOREIGN PATENT DOCUMENTS

| | | |
|---|---|---|
| 1,922,345 | 3/1971 | Germany |
| 744,425 | 1/1944 | Germany |
| 1,252,467 | 5/1968 | Germany |
| 898,977 | 12/1953 | Germany |
| 910,342 | 11/1962 | United Kingdom |

*Primary Examiner*—Tim R. Miles

*Attorney, Agent, or Firm*—Stevens, Davis, Miller & Mosher

[57] ABSTRACT

A fuel supply system for a heat generator comprises means for spraying fuel into an air inlet tube, which means are branched off a fuel supply line supplied by a pump having a fuel delivery greater than the fuel comsumption rate of the generator. The fuel line extends to a constant-level chamber by way of a variable-opening throttle element controlled in dependence upon the air flow through the inlet tube, the pump intake being connected to the constant-level chamber. A bypass circuit is adapted to connect the fuel pump output to a fuel reservoir and is closed by a calibrated valve which opens in response to a predetermined fuel pump delivery rate so that the fuel in the constant-level chamber is renewed when the rate of generator fuel comsumption is low.

10 Claims, 1 Drawing Figure

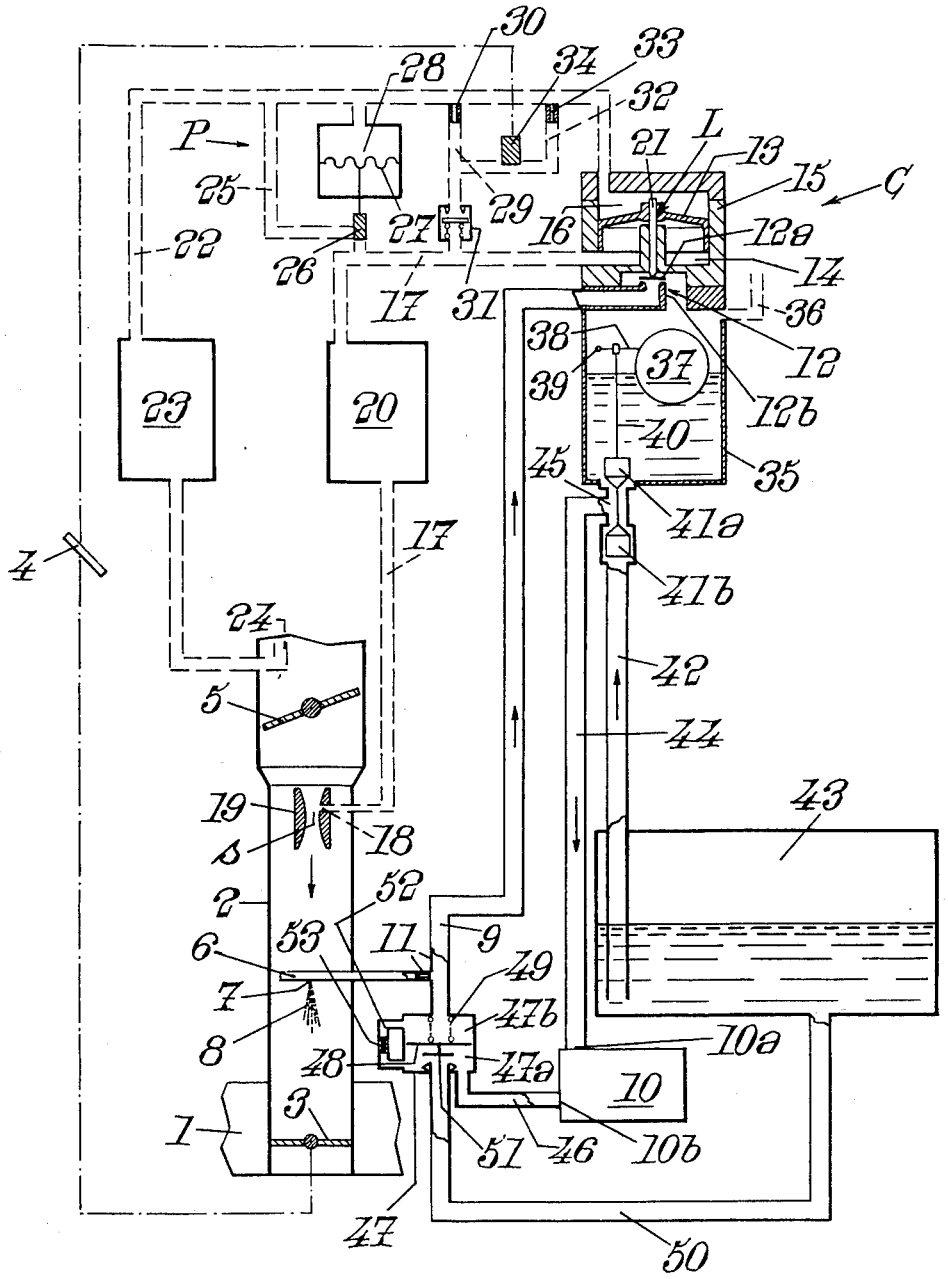
30
28
34
33
32
P
21
L
13
15
C
25
29
16
12a
22
26
27
14
17
31
36
38
12
39
37
12b
23
20
40
35
45
41a
4
17
41b
24
42
5
44
43
19
18
s
2
52
53
11
9
6
49
7
47b
8
10a
48
47a
10
3
1
51
46
10b
47
50

FUEL SUPPLY SYSTEMS FOR HEAT GENERATORS

BACKGROUND OF THE INVENTION

This invention relates to a fuel supply system for a heat generator of the kind comprising at least one fuel spray tube disposed in an air inlet tube for the generator, the spray tube being connected to a fuel feed connection in a line supplied with fuel under pressure by a pump having a delivery greater than the fuel consumption rate of the generator, the latter line being connected to the pump output and having downstream of the fuel feed connection a variable-opening throttle element acted upon by control means responsive to the air flow through the inlet tube, the pressure fuel line extending by way of the variable-opening throttle element to a constant-level chamber into which the excess fuel circulated by the pump flows, the pump intake being connected to the constant-level chamber, the control means for the throttle element comprising a moving element forming a movable wall of a chamber experiencing a negative pressure produced by the air flow through a portion of the inlet tube and connecting means between such moving element and the throttle element, the latter means being so devised that the fuel pressure in the spray tube feed line is under the control of the rate of air flow to the generator.

The invention is applicable to heat generators, such as external combustion engines, including burners for steam engine boilers, and to valved and ported internal combustion engines such as 4-stroke or 2-stroke engines and rotary piston engines.

It is an object of the invention to improve the practical performance of such a fuel supply system, interalia so as to provide improved low-load operation of the heat generator, i.e. to improve the operation thereof when the rate of fuel consumption by the generator is low.

SUMMARY OF THE INVENTION

According to the invention, there is provided a fuel supply system of the kind hereinbefore defind which comprises a bypass circuit adapted to connect the fuel pump output to a fuel reservoir, the bypass circuit being closed by a calibrated valve which is disposed upstream of the spray tube feed connection and which opens in response to a predetermined rate of fuel pump delivery, so that the fuel in the constant-level chamber is renewed when the rate of generator fuel consumption is low.

Preferably, the valve is biassed by resilient means towards the inlet of the bypass duct and is disposed in an enclosure divided into two chambers by a partition, the chamber in which the valve is disposed being connected to the delivery of the pump, the other chamber being connected to the line which extends to the constant-level chamber, a line which comprises a reduced-diameter calibrated portion being provided as a means of communication between the chambers.

Advantageously, the spray tube feed connection comprises a narrow cross-section jet so disposed that one of its surfaces is in contact with the excess delivery from the fuel pump.

The fuel supply system can comprise a double needle valve operated by a float in the constant-level chamber, such valve being disposed in a line connecting such chamber to a fuel reservoir at the place where the latter line it itself connected to a connecting duct connected to the fuel pump intake, so that the fuel pump can pressurize the spray tube and also fill the constant-level chamber.

As a rule, the moving element of the throttle element control means, which can take inter alia the form of a piston or diaphragm is so disposed in an enclosure as to bound therein two chambers connected to a vacuum offtake disposed in the air inlet tube, more particularly at the throat of a venturi, and to a total pressure offtake, respectively; the throttle element is an ordinary valve member; and the connectng means between the moving element and the throttle element are constituted by a tappet or the like connected to the moving element and bearing directly on the valve member.

The fuel supply system may also comprise means adapted to provide one or more communications between the vacuum offtake duct and the total pressure offtake duct as a means of providing various balances at the throttle element and of thus providing substantially constant but different ratios between the generator air intake rate and the generator fuel intake rate.

BRIEF DESCRIPTION OF THE DRAWING

In addition to the features hereinbefore outlined, the invention comprises other features which will become apparent from the following description of a preferred embodiment of the invention given with reference to the accompanying drawing.

The single FIGURE forming the accompanying drawing is a diagrammatic view of a fuel supply system according to the invention.

DESCRIPTION OF PREFERRED EMBODIMENT

In the drawing, an internal combustion engine 1 shown in schematic form has an air inlet tube 2 in which is disposed a main throttle valve 3 which can be opened and closed by a control such as an accelerator pedal 4.

Also disposed in tube 2 upstream of valve 3 as considered in the airflow direction (shown arrowed) is a choke valve 5 which is controlled manually or automatically and which helps to increase the depression in tube 2 downstream of valve 5 for cold starting of the engine ("starter function").

The fuel supply system comprises at least one spray means 6 schematically shown as transversely disposed tube which projects into tube 2 between valves 3 and 5, spray tube 6 being formed with orifices 7 through which liquid fuel is discharged into tube 2 in the form of a spray 8.

Tube 6 is connected into a fuel line 9 supplied with fuel under pressure by a continuously delivery pump 10, inter alia a centrifugal pump. Tube 6 is, as it were, branched off line 9, in the manner shown, by means of a feed connection 11 in the form of a jet having a calibrated orifice of small cross-section.

The tube 6 could be disposed downstream of valve 3 as considered in the airflow direction, in which event tube 6 would have to communicate with atmosphere downstream of calibrated orifice 11.

That zone of line 9 in which the jet is disposed is flowed through by the fuel consumed by the engine and by the excess delivery which is led by line 9 to a throttle element 12. That surface of the jet 11 which experiences pressure is in contact with the liquid flowing through line 9.

The throttle element 12, whose opening is adjustable, is disposed in line 9, downstream of feed connection 11 as considered in the fuel flow direction (shown arrowed) and takes the form inter alia of an ordinary valve member 12*a* adapted to cooperate with a valve seat 12*b*.

Element 12 is acted on by control means C responsive to the airflow through inlet tube 2 and comprising a moving element 13 forming a movable wall of a chamber which experiences a negative pressure produced by the airflow through a portion *s* of air inlet tube 2. The moving element 13 as shown is embodied by a dished piston sliding in a cylinder 15 and dividing the same into a first chamber 14 and a second chamber 16. A duct 17 connects chamber 14 to a vacuum offtake 18. In the drawing, duct 17 and the other air ducts are shown in chain lines whereas fuel ducts are shown in solid lines.

Advantageously, the portion *s* is formed by the throat of a venturi 19 which is disposed in tube 2 coaxially thereof between the valves 3 and 5. The vacuum offtake 18 takes the form of a passage which opens into the venturi throat and whose axis is perpendicular to the general direction of the airflow. Advantageously, a capacity 20 is provided on line 17 between the vacuum offtake 18 and the chamber 14 to even out the air pressure and smooth out pressure variations.

Connecting means L are so disposed between the moving element 13 and the throttle element 12 that increased depression in tube 2 causes a closure of valve member 12*a* and therefore an increase in the fuel pressure in line 9 and vice versa for a decrease in the negative pressure in tube 2. Advantageously the connecting means L are embodied by a rod 21 which acts as a tappet rigidly secured to piston 13 ad coaxial of cylinder 15, the rod 21 extending through the bottom of cylinder 15 and abutting valve member 12*a*.

By way of a duct 22 including a pressure-smoothing capacity 23, the second chamber 16 is connected to a total pressure offtake 24 disposed upstream of the valve 5 in tube 2 and embodied as a nozzle extending parallel to the axis of tube 2 and open towards the upstream direction thereof, the open cross-section of nozzle 24 being disposed in a plane perpendicular to the axis of the tube 2. The duct 22 therefore transmits the total pressure in tube 2 to chamber 16.

The capacities 20, 23 can comprise diaphragm pulsators to damp oscillations.

Means P for establishing restricted communications between the ducts 22 and 17 are provided, in the form of a first duct 29 interconnecting those parts of the duct 17 and 22 which are disposed between the cylinder 15 and the respective capacities 20, 23. The first duct 29 is formed with a narrow calibrated orifice 30 which is disposed near the place where duct 29 joins duct 22. Duct 29 also has a calibrated valve 31 adapted to open and establish communication between the ducts 22 and 17 when the pressure difference therebetween exceeds a predetermined value. Valve 31 is disposed in duct 29 near the junction thereof with duct 17.

A second duct 32 is connected in parallel between ducts 29 and 22. Duct 32 joins duct 22 by way of a narrow calibrated orifice 33. Duct 32 joins duct 29 between calibrated orifice 30 and valve 31. A valve 34 shown schematically is provided in duct 32 and is controlled e.g. by the accelerator 4, the complete system being such that valve 34 closes when accelerator 4 reaches its extreme position corresponding to maximum engine power. The operaton of valve 34 can be either of the on/off kind, givien abrupt openings and closings or progressive.

More generally, operation of valve 34 depends on parameters of the generator and could be controlled inter alia in dependence upon engine torque or engine speed independently of the control of throttle valve 3.

The means P also comprise a third duct 25 interconnecting those parts of the ducts 17, 22 disposed between cylinder 15 and the respective capacities 20, 23. Duct 25 is closed by a valve 26 which is shown schematically and which is controlled by a sealed deformable capsule 27 such as a barometer capsule, the same being disposed in an enclosure 28 which is connected to the duct 22 and which is therefore at the total pressure of the tube 2. The moving part of capsule 27 varies the opening of valve 26 in accordance with pressure variations in the enclosure 28 so that valve 26 opens gradually when the pressure in enclosure 28 decreases.

Other similar forms of communication, such as calibrated orifices or calibrated valves or valves controlled by vacuum capsules or by centrifugal means could be provided to act on the relationship between generator air intake and generator fuel intake.

Fuel line 9 extends to a constant level float chamber 35, the throttle element 12 being disposed at that end of line 9 which is in chamber 35. At the top thereof is a tube 36 via which the interior of chamber 35 communicates with atmosphere to maintain the interior of the chamber 35 at atmospheric pressure.

A float 37 rigidly secured to a rod 38 pivoted to a stationary part 39 of the chamber 35 is disposed therein for constant level purposes; a rod 40 connects rod 38 to a double needle valve 41*a*, 41*b*. A duct 42 connects chamber 35 to a fuel reservoir 43 and extends to the bottom of chamber 35. A duct 44 connects pump intake 10a to an orifice 45 which is disposed in duct 42 near the bottom of chamber 35 and between the valves 41*a* and 41*b*.

The whole is such that, when the level in chamber 35 drops and float 37 descends, the needle valve 41a secured to rod 40 closes the bottom of chamber 35 and the orifice communicating with duct 42. When the chamber 35 tends to overfill, valve 41*b* which is also secured to rod 40 rises with float 37 and closes duct 42 at a restricted part, communication still remaining between chamber 35 and the pump intake 10*a*.

In the variant the chamber 35 could be kept at a constant level by means of an auxiliary pump intaking from reservoir 43, in which event the pump intake 10*a* would be connected only to chamber 35. The feature comprising the use of the double needle valve 41*a*, 41*b* would not be used and the chamber 35 would be filled and maintained by a conventional feed pump which would be separate from the pump 10 and which could be a pump such as is used in association with carburettors and which is not shown; such a pump would supply chamber 35 directly from the supply reservoir 43.

A delivery duct 46 connects pump output 10*b* to an enclosure 47 which is divided into two chambers 47*a*, 47*b* by a piston-like partition 48 acted on by a spring 49 disposed in the chamber 47*b*, the delivery duct 46 opening into chamber 47*a*.

A line 50 forms a bypass circuit which connects chamber 47*a* to reservoir 43. Wall 48 carries a valve 51 which is disposed upstream of feed connection 11 and which is adapted to be applied by spring 49 to the end of duct 50 to close such end.

A duct 52 provides communication between the chambers 47*a* and 47*b* and has a narrow calibrated portion 53. Line 9 starts from chamber 47*b* and the feed connection 11 is disposed downstream of chamber 47*b*.

A system of the kind hereinbefore described operates as follows:

The depression at 18 at the throat of venturi 19, such depression being substantially proportional to the square of the rate of airflow passing into the engine through tube 2, acts on the moving element 13. The square of the rate of fuel flow through the calibrated feed connection 11 is substantially proportional to the fuel pressure upstream of connection 11 — i.e. to the fuel pressure in line 9. Such pressure, which is transmitted to valve 12*a*, is in turn in a constant relationship with the depression at the venturi throat.

The system according to the invention is therefore a means of producing a substantially constant ratio between the rate of airflow entering the engine through tube 2 and the rate of fuel flow sprayed into the engine through spray tube 6.

As previously stated, pump delivery is greater that can be absorbed by the engine; consequently, all the excess delivery shows very near the connection 11 and the jet and goes to valve 12 and chamber 35. The excess fuel helps to keep the fuel near the feed connection 11 and spray tube 6 at a low temperature, so that local evaporation of fuel and the evolution of gases included therein are reduced. Parasitic gas emissions are retarded or inhibited in the fuel, with the result of improved engine operation.

When the engine is required to run at low power, the rate of air flow into the engine and the depression in the duct 17 are also low.

When engine output is increased by the rate of air flow into the engine being increased, the speed of the air flowing through the tube 2 increases and the depression at the venturi throat and in the duct 17 increases.

The valve 31 opens at a predetermined value to interconnect the ducts 22 and 17 at least by way of the calibrated orifice 30 and the duct 29. The establishment of such a communication between the ducts 22 and 27 reduces the relative depression between the chambers 14 and 16 because air flow from duct 22 to duct 17 through orifice 30.

Whe the depression acting on the piston or diaphragm 13 decreases, the throttle element 12 tends to be opened because the valve member 12*a* rises, and so the fuel pressure in line 9 decreases proportionally.

Consequently, for a given rate of airflow the rate of fuel flow taken by the engine is reduced and the richness of the fuel-air mixture is weakened. However, in the new operating conditions the supply system according to the invention maintains the new richness mixture substantially constant.

Similarly, when valve 34 is opened an additional communication exists between the ducts 22 and 17 by way of the calibrated orifice 33 and the duct 32, so that the depression acting on the moving element 13 is further reduced and there is a further weakening of the mixture richness.

When valve 34 closes gradually or abruptly, according to whether or not an interruption in engine power is acceptable, the richness of the fuel-air mixture is increased and so the power output by the engine can be increased for a given rate of airflow. As previously mentioned, this closure of the valve 34 is contrived to occur, for instance, when the accelerator-operated main throttle valve 3 is fully open, so that extra engine power is made available at high powers.

The valves 34, 31 are in the closed state at low engine powers including starting, so that the fuel-air mixture is rich and facilitates starting.

The pressure-sensitive capsule 27 in the duct 22 opens the valve 26 gradually in proportion as the pressure in duct 22 decreases. A gradual communication is therefore established between the ducts 22 and 17 so that there is a progressive weakening of the fuel-air mixture.

The pressure in the duct 22 is provided by means of the total pressure offtake 24 and differs from the atmospheric pressure outside the engine only because of the existence of pressure drops in the engine air intake trunking and, where applicable, by the engine intake silent-filter device. There is therefore relatively little difference between the pressure in ducts 22 and the outside atmospheric pressure, and the valve 26 operated by the capsule 27, e.g. a barometer capsule, is a means of correcting the richness of the fuel-air mixture in dependence on atmospheric pressure and inter alia in dependence upon the altitude at which the engine operates.

The excess fuel not supplied to the engine by the spray tube 6 flows through line 9 to throttle element 12, passes through the same and into the constant level chamber 35 to which the fuel pump intake is connected.

The facility 47–49 is so adjusted that at low engine consumptions the valve 51 disengages from the end of duct 50 so that fuel returns directly to reservoir 43 through duct 50, for when engine consumption is low the pressure in the line 9 is low, and so the throttle element 12 is in a very open position.

There is therefore a relatively high rate of fuel flowing through the calibrated orifices 53, with the result of a considerable pressure drop thereacross. Such pressure drop acts on the wall 48 and is operative, against the force of spring 49, in the direction tending to open valve 51. The opening of valve 51 occurs at a predetermined value of the fuel flow rate.

The return of some of the fuel through duct 50 to reservoir 43 is a means of providing an exchange between the chamber 35 and the reservoir 43 and therefore of renewing the fuel, for if the level in the chamber 35 is high, the float 37 is in a high position in the chamber 35 and the needle valve 41*b* closes the duct 42. The pump 10 intakes fuel only from chamber 35. In the absence of bypass duct 50, the excess fuel of the chamber 35 would be removed only via the spray tube 6 at low engine powers, and since the delivery of spray tube 6 is small, considerable time would be taken to remove the excess fuel from the chamber 35; the fuel of chamber 35 would therefore flow in a closed circuit through the ducts 44 and 9 and would increase in temperature. The bypass duct 50 and the valve 51 enable much of the excess fuel to be diverted through the reservoir 43. The level of chamber 35 therefore drops rapidly, valve 41*a* closes and valve 41*b* opens. Fuel at a relatively low temperature is then pumped from reservoir 43, through duct 42, orifice 45, conduits 44, 46, 52 and 9 and into chamber 35.

Renewal of the fuel in the constant-level chamber 35 is therefore a means of maintaining an acceptable relatively low temperature in chamber 35, with a very appreciable reduction of parasitic phenomena due to gas emissions in the fuel, particularly in low-power operating conditions of the generator.

Thanks to the double-needle valve device 41*a*, 41*b*, the pump 10 simultaneously fills the chamber 35 since the excess fuel returns thereto via the throttle element 12.

The steady flow of fuel helps to reduce very considerably the formations of hot zones causing parasitic phenomena of gas emissions in the fuel. The jet 11, which is in constant contact with flowing fuel, is also kept at a low temperature.

I claim:

1. A fuel supply system for a heat generator, comprising: an air inlet tube for the generator; at least one fuel spray tube disposed in said air inlet tube; a fuel pump having a delivery greater than the fuel consumption rate of the generator, said pump having an intake and a delivery duct; a fuel line connected to said pump delivery duct and having a fuel feed connection to said spray tube; a variable-opening throttle element disposed in said fuel line downstream of said fuel feed connection; a constant-level chamber connected to said fuel line downstream of said throttle element for receiving excess fuel circulated by said pump, said chamber being connected to the intake of said pump; and control means to control said throttle element in dependence on the air flow through said inlet tube, said control means comprising a moving element forming a movable wall of a chamber subjected to a negative pressure produced by the air flow through a portion of said inlet tube and connecting means between said moving element and said throttle element; said fuel supply system being characterised by: a fuel reservoir; a bypass circuit connecting said pump delivery duct to said fuel reservoir; and calibrated valve means disposed in said bypass circuit upstream of said spray tube feed connection, said valve means closing said bypass circuit at high rates of fuel consumption and opening said bypass circuit in response to a predetermined low rate of fuel consumption so that the fuel in said constant-level chamber is renewed when the rate of generator fuel consumption is low.

2. A system as claimed in claim 1, wherein said bypass circuit comprises a bypass duct having an inlet, said system further comprising: an enclosure divided into two chambers by a partition, one of said chambers communicating with said pump delivery duct and said bypass duct inlet and housing said calibrated valve means, the other of said chambers being connected to said fuel line, said chambers communicating via a line comprising a reduced-diameter calibrated portion; and resilient means biasing said calibrated valve means towards said bypass duct inlet.

3. A system as claimed in claimm 1, wherein said spray tube feed connection comprises a narrow cross-section jet so disposed that one of its surfaces is in contact with the excess delivery from the fuel pump.

4. A system as claimed in claim 1, wherein said constantlevel chamber has a float therein, said system further comprising: a line connecting said constant-level chamber to said fuel reservoir; a connecting duct connecting said connecting line to said fuel pump intake; and a double needle valve operated by said float and disposed in said connecting line where the latter is connected to said fuel pump intake connecting duct, so that said fuel pump can pressurise said spray tube and also fill said constant-level chamber.

5. A system as claimed in claim 1, further comprising: a vacuum offtake duct connected to said inlet tube; and a total pressure offtake duct connected to said inlet tube; said throttle element being a valve member; said control means comprising an enclosure in which said moving element is disposed so as to bound therein a first chamber connected to said vacuum offtake and a second chamber connected to said total pressure offtake, and connecting means in the form of a tappet connected to said moving element and bearing directly on said valve member.

6. A system as claimed in claim 5, further comprising means to provide one or more communications between said vacuum offtake duct and said total pressure offtake duct to provide various balances at the throttle element and thus to provide substantially constant but different ratios between the generator air intake rate and the generator fuel intake rate.

7. A system as claimed in claim 6, wherein said communicating means comprise a connecting duct interconnecting said vacuum offtake duct and said total pressure offtake duct and formed with a calibrated orifice.

8. A system as claimed in claim 7, wherein said connecting duct comprises a valve so calibrated as to open and establish communication between said vacuum offtake duct and said total pressure offtake duct when the pressure therebetween exceeds a predetermined value.

9. A system as claimed in claim 6 wherein said communicating means comprise a duct interconnecting said total pressure offtake duct and said vacuum offtake duct and formed with a calibrated orifice and having a valve whose operation is associated with the operation of the generator.

10. A system as claimed in claim 6 wherein said communicating means comprise a duct which interconnects said vacuum offtake duct and said total pressure offtake duct and which is closed by a valve operated by a hermetically sealed capsule, receiving the total pressure in said inlet tube, said capsule being adapted to open said valve progressively in response to a decrease in the total pressure.

* * * * *